US006315890B1

(12) United States Patent
Ladwig et al.

(10) Patent No.: US 6,315,890 B1
(45) **Date of Patent: *Nov. 13, 2001**

(54) NAPHTHA CRACKING AND HYDROPROCESSING PROCESS FOR LOW EMISSIONS, HIGH OCTANE FUELS

(75) Inventors: Paul K. Ladwig, Randolph, NJ (US); Gordon F. Stuntz, Baton Rouge, LA (US); Garland B. Brignac, Clinton, LA (US); Thomas R. Halbert, Baton Rouge, LA (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,660

(22) Filed: Nov. 10, 1999

Related U.S. Application Data

(63) Continuation-in-part of application No. 09/073,085, filed on May 5, 1998, now Pat. No. 6,069,287.

(51) Int. Cl.[7] ..... C10G 69/04

(52) U.S. Cl. ..... 208/67; 208/135; 208/120.01; 208/72; 208/68; 208/97; 208/217; 208/213; 208/215; 208/216 R; 585/648; 585/649; 585/650; 585/651; 585/653

(58) Field of Search ..... 585/648, 649, 585/650, 651, 653; 208/135, 120.01, 72, 67, 68, 97, 213, 215, 216 R, 217

(56) References Cited

U.S. PATENT DOCUMENTS

| | | | | |
|---|---|---|---|---|
| 3,442,792 | | 5/1969 | Eng et al. | 208/62 |
| 3,533,937 | | 10/1970 | Stankis | 208/62 |
| 3,770,618 | * | 11/1973 | Adams et al. | 208/216 |
| 3,801,494 | | 4/1974 | Moore et al. | 208/79 |
| 3,893,905 | | 7/1975 | Fenske et al. | 208/103 |
| 3,899,543 | * | 8/1975 | Cosyns et al. | 260/267 |
| 3,928,172 | | 12/1975 | Davis, Jr. et al. | 208/77 |
| 3,957,625 | | 5/1976 | Orkin | 208/211 |
| 3,959,116 | | 5/1976 | Arey, Jr. et al. | 208/66 |
| 4,171,257 | | 10/1979 | O'Rear et al. | 208/120 |
| 4,282,085 | | 8/1981 | O'Rear et al. | 208/120 |
| 4,502,945 | | 3/1985 | Olbrich et al. | 208/120 |
| 4,830,728 | | 5/1989 | Herbst et al. | 208/78 |
| 4,865,718 | | 9/1989 | Herbst et al. | 208/70 |
| 4,927,526 | | 5/1990 | Anderson et al. | 208/152 |
| 4,950,387 | | 8/1990 | Harandi et al. | 208/49 |
| 4,975,179 | | 12/1990 | Harandi et al. | 208/66 |
| 5,026,935 | | 6/1991 | Leyshon et al. | 585/315 |
| 5,026,936 | | 6/1991 | Leyshon et al. | 585/315 |
| 5,041,208 | | 8/1991 | Patridge et al. | 208/138 |
| 5,043,522 | | 8/1991 | Leysohn et al. | 585/651 |
| 5,047,142 | * | 9/1991 | Sherwood, Jr. et al. | 208/251 H |
| 5,069,776 | | 12/1991 | Biswas et al. | 208/120 |
| 5,094,994 | * | 3/1992 | Sherwood, Jr. et al. | 502/314 |
| 5,143,596 | | 9/1992 | Maxwell et al. | 208/89 |
| 5,160,424 | | 11/1992 | Le et al. | 208/67 |
| 5,171,921 | | 12/1992 | Gaffney et al. | 585/653 |
| 5,286,373 | | 2/1994 | Sudhakar et al. | 208/216 |
| 5,292,976 | | 3/1994 | Dessau et al. | 585/322 |
| 5,346,609 | | 9/1994 | Fletcher et al. | 208/89 |
| 5,347,061 | | 9/1994 | Harandi et al. | 585/323 |
| 5,348,928 | | 9/1994 | Kukes et al. | 502/306 |
| 5,358,633 | | 10/1994 | Dai et al. | 208/216 |
| 5,372,704 | | 12/1994 | Harandi et al. | 208/74 |
| 5,378,352 | | 1/1995 | Degnan et al. | 208/217 |
| 5,389,232 | | 2/1995 | Adewuyi et al. | 208/120 |
| 5,396,010 | | 3/1995 | Harandi et al. | 585/418 |
| 5,409,596 | | 4/1995 | Fletcher et al. | 208/89 |
| 5,414,172 | | 5/1995 | Chin et al. | 585/322 |
| 5,468,372 | * | 11/1995 | Seamans et al. | 208/216 R |
| 5,472,594 | | 12/1995 | Tsang et al. | 208/114 |
| 5,525,211 | | 6/1996 | Sudhakar et al. | 208/217 |
| 5,576,256 | | 11/1996 | Monque et al. | 502/61 |
| 5,591,324 | | 1/1997 | Monque et al. | 208/216 R |
| 5,643,441 | | 7/1997 | Timken et al. | 208/89 |
| 5,770,047 | | 6/1998 | Salazar et al. | 208/254 R |
| 5,865,987 | | 2/1999 | Borghard et al. | 208/97 |
| 5,865,988 | | 2/1999 | Collins et al. | 208/97 |
| 5,951,963 | | 9/1999 | He et al. | 423/713 |
| 5,985,136 | * | 11/1999 | Brinac et al. | 208/216 R |
| 6,069,287 | * | 5/2000 | Ladwig et al. | 585/648 |
| 6,093,867 | * | 7/2000 | Ladwig et al. | 585/648 |
| 6,106,697 | * | 8/2000 | Swan et al. | 208/77 |
| 6,118,035 | * | 9/2000 | Fung et al. | 585/653 |
| 6,126,812 | | 10/2000 | Drake et al. | 208/134 |
| 6,126,814 | * | 10/2000 | Lapinski et al. | 208/217 |
| B1 4,177,136 | * | 5/1994 | Herrington et al. | 208/215 |

FOREIGN PATENT DOCUMENTS

| | | | |
|---|---|---|---|
| 0109060 A1 | 5/1984 | (EP) | C07C/11/06 |
| 0347003 B1 | 5/1996 | (EP) | C10G/11/05 |
| 0921179 A1 | 6/1999 | (EP) | C10G/11/05 |
| 0921181 A1 | 6/1999 | (EP) | C10G/11/05 |
| 0093475 A1 | 4/1982 | (EP) | C10G/35/06 |
| 0235416 A1 | 9/1987 | (EP) | C10G/35/095 |
| 0420326 A1 | 4/1991 | (EP) | C10G/35/095 |
| 0557527 A1 | 9/1993 | (EP) | C10G/35/095 |
| 0022883 A1 | 1/1981 | (EP) | C10G/69/04 |
| WO98/56874 | 12/1998 | (WO) | C10G/11/00 |
| WO 01/04237 | 1/2001 | (WO) | C10G/11/00 |

OTHER PUBLICATIONS von Ballmoos et al., *Three Dimensional Mapping of the Zoned Aluminum Distribution in ZSM–5,* Proceedings of the Sixth International Zeolite Conference, Reno, NV, Jul. 10–15, 1983, published by Butterworths & Co., Guilford, Engl., pp. 803–811, (1984).

*Journal of Catalysis,* vol. 71, pp. 447–448, (1981)—No Month.

(List continued on next page.)

*Primary Examiner*—Nadine Preisch

(57) ABSTRACT

The invention is related to a two step process wherein the first step comprises cracking an olefinic naphtha resulting in a cracked product having a diminished total concentration of olefinic species. The second step comprises hydroprocessing at least a portion of the cracked product, especially a naphtha fraction, to provide a hydroprocessed cracked product having a reduced concentration of contaminant species but without a substantial octane reduction.

11 Claims, No Drawings

OTHER PUBLICATIONS

Derouane et al., *Applied Catalysis,* vol. 1, pp. 201–224, (1981)—No Month.
Jacobs et al., *J. Phys. Chem.,* vol. 86, pp. 3050–3052 (1982)—No Month.
Fleisch et al., *Journal of Catalysis,* vol. 99, pp. 117–125 (1986)—No Month.
Meyers et al., *Journal of Catalysis,* vol. 110, pp. 82–95 (1988)—No Month.
Gross et al., Surface composition of dealuminated Y zeolites studied by X–ray photoelectron spectroscopy (Mar. 8, 1983).
Kung, *Stud. Surf. Sci. Catal.,* vol. 122, pp. 23–33, (1999)—No Month.

* cited by examiner

NAPHTHA CRACKING AND HYDROPROCESSING PROCESS FOR LOW EMISSIONS, HIGH OCTANE FUELS

CROSS-REFERENCE TO RELATED APPLICATION

This is a continuation-in-part of U.S. Ser. No. 09/073,085 filed May 5, 1998, now U.S. Pat. No. 6,069,287.

BACKGROUND OF THE DISCLOSURE

1. Field of the Invention

The present invention relates to a process for hydroprocessing a catalytically cracked or thermally cracked naphtha stream. More particularly, the invention relates to a process for cracking an olefinic naphtha using a zeolite catalyst to form a cracked product having a diminished total olefin concentration, and then hydroprocessing at least a portion of the cracked product in a manner that reduces the sulfur concentration while substantially retaining the olefin content in order to maintain octane.

2. Background of the Invention

The need for low emissions, high octane fuels has created an increased demand for light olefins for use in alkylation, oligomerization, MTBE and ETBE synthesis processes. In addition, a low cost supply of $C_2$ to $C_4$ olefins, particularly propylene, continues to be in demand to serve as feedstock for polyolefin, particularly polypropylene production. In parallel with this need, increasingly stringent regulations require motor fuels having a diminished concentration of sulfur and, to a lesser extent, olefins boiling in the gasoline boiling range ($C_4$ and above).

It is well known that conventional fluid catalytic cracking ("FCC") processes can be adapted to increase product $C_2$ to $C_4$ olefin concentration. Some of the adaptations include dual risers, combinations of cracking and metathesis, and the use of zeolite catalysts. Hydroprocessing cracked naphtha formed in such processes typically results in a product having a diminished concentration of olefinic species and non-hydrocarbyl species such as sulfur-containing species, and an augmented concentration of saturated species. Relatively severe hydroprocessing conditions are generally required to substantially remove sulfur-containing species, particularly in the presence of olefinic species having more than four carbon atoms, and such severe hydroprocessing conditions are known to result in a substantial octane reduction in the hydroprocessed product.

There remains a need, therefore, for new processes for forming $C_2$ to $C_4$ olefins together with naphtha having a diminished concentration of sulfur-containing species, while maintaining a sufficient amount of $C_4$ and larger olefins in the naphtha, preferably $C_5$ and $C_6$ olefins, to provide a relatively high octane.

SUMMARY OF THE INVENTION

In one embodiment, the invention is a process for forming a hydroprocessed product comprising:

(a) reacting an olefinic naphtha in the presence of a molecular sieve catalyst under catalytic cracking conditions in order to form a product, and then (b reacting at least a portion of the product under hydroprocessing conditions in the presence of a hydroprocessing catalyst in order to form the hydroprocessed product.

In another embodiment, the invention is a hydroprocessed product formed according to such a process.

In a preferred embodiment, the olefinic naphtha is reacted in a process unit comprised of a reaction zone, a stripping zone, and a catalyst regeneration zone. In the reaction zone, the naphtha stream is contacted under catalytic conversion conditions a catalytically effective amount of molecular sieve catalyst having an average pore diameter of less than about 0.7 nm, preferably zeolite, and more preferably ZSM-5 catalyst, that is preferably in the form of a fluidized bed. The reaction zone is operated at a temperature from about 500° to 650° C., a hydrocarbon partial pressure of 10 to 40 psia, a hydrocarbon residence time of 1 to 10 seconds, and a catalyst to feed weight ratio of about 2 to 10. Preferably, less than about 20 wt. % of paraffins are converted to olefins.

Preferably, at least a portion of the product from the catalytic cracking unit is conducted to a hydroprocessing unit. Preferably, the hydroprocessing reactor is operated at a temperature from about 250° C. to about 375° C., a hydrogen partial pressure of 50 to 500 psig, and a liquid hourly space velocity of 2–10. The hydrogen treat rate is about 500 to 3000 scf/bbl and the preferred hydroprocessing catalyst is comprised of an alumina support with Co and Mo added to it.

Preferably, the olefinic naphtha feedstock contains about 10 to 30 wt. % paraffins, and from about 20 to 70 wt. % olefins.

DETAILED DESCRIPTION OF THE INVENTION

The invention is based on the discovery that catalytically cracking an olefinic naphtha under appropriate conditions results in the formation of light (i.e., $C_{2-C4}$) olefins and a cracked naphtha. The invention is also based on the discovery that a portion of such a cracked naphtha may be separated and then hydrotreated under appropriate conditions to yield a product having a diminished sulfur concentration while maintaining or at least not substantially reducing its octane rating. Moreover, it has been discovered that cracking an olefinic naphtha under appropriate conditions results in an overall reduction in olefinic species' concentration and an increased concentration of desirable light (i.e., $C_2$ to $C_4$) olefins in the cracked product. While not wishing to be bound by any theory, it is believed that diminishing the overall olefin concentration permits hydroprocessing of the cracked naphtha fraction under more selective conditions.

Accordingly, the invention is related to a two step process wherein the first step comprises cracking an olefinic naphtha resulting in a cracked product having a diminished total concentration of olefinic species. When the olefinic naphtha feed is obtained from processes such as catalytic cracking, steam cracking, or coking, then the first step may be referred to as re-cracking. The second step comprises hydroprocessing at least a portion of the cracked product to provide a hydroprocessed cracked product having a reduced concentration of contaminants such as non-hydrocarbyl species but without a substantial octane reduction.

Naphtha feeds include olefinic naphthas having hydrocarbyl species boiling in the naphtha range. More specifically, the olefinic naphthas contain from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F., preferably from about 65° F. to about 300° F., and more preferably from 65° F. to about 1 50F. The naphtha may be a thermally cracked or a catalytically cracked naphtha. Such naphthas may be derived from any appropriate source, for example, they can be derived from the fluid catalytic cracking (FCC) of gas oils and resids or from delayed or fluid coking of resids. Preferably, the naphtha streams are derived from the fluid catalytic cracking of gas oils and resids. Such naphthas are typically rich in olefins, diolefins, and mixtures thereof, and relatively lean in paraffins.

In one embodiment, the cracking process of the present invention may be performed in one or more process units comprised of a reaction zone, a stripping zone, a catalyst regeneration zone, and a fractionation zone. The naphtha feedstream is conducted into the reaction zone where it contacts a source of hot, regenerated catalyst. The hot catalyst vaporizes and cracks the feed at a temperature from about 500° C. to 650° C., preferably from about 500° C. to 600° C. The cracking reaction deposits carbonaceous hydrocarbons, or coke, on the catalyst, thereby deactivating the catalyst. The cracked products may be separated from the coked catalyst and a portion of the cracked products may be conducted to a fractionator. The coked catalyst is passed through the stripping zone where volatiles are stripped from the catalyst particles with steam. The stripping can be preformed under low severity conditions in order to retain adsorbed hydrocarbons for heat balance. The stripped catalyst is then passed to the regeneration zone where it is regenerated by burning coke on the catalyst in the presence of an oxygen containing gas, preferably air. Decoking restores catalyst activity and simultaneously heats the catalyst to, e.g., 650° C. to 750° C. The hot catalyst is then recycled to the reaction zone to react with fresh naphtha feed. Flue gas formed by burning coke in the regenerator may be treated for removal of particulates and for conversion of carbon monoxide, after which the flue gas is normally discharged into the atmosphere. At least a portion, preferably a naphtha portion, and more preferably a naphtha portion rich in $C_5$ and $C_6$ olefin, of the cracked products from the reaction zone is separated for subsequent hydroprocessing in step (b) in the Summary of the Invention. Other portions, when present, may be separated for storage, further processing, recycling, or some combination thereof. The separation may occur in one or more fractionation zones.

In one embodiment, at least a naphtha fraction boiling in the range of 65° F. to 150° F. (i.e., light cat naphtha) is separated from the cracked product of step (a), and at least a portion of the light cat naphtha is hydroprocessed in step (b). Intermediate and heavy cat naphtha fractions may also be separated from the cracked product, and portions thereof may be subsequently hydroprocessed. Moreover, mixtures of light cat naphtha, intermediate cat naphtha, and heavy cat naphtha separated from the cracked product may also be subsequently hydroprocessed. Lighter fractions such as $C_2$, $C_3$, and $C_4$ fractions may be separated from the cracked product for storage, further processing, or some combination thereof.

The cracking step may be practiced in a conventional FCC process unit under FCC conversion conditions in order to increase light olefin yields in the FCC process unit itself. In another embodiment, the invention uses its own distinct process unit, as previously described, which receives olefinic naphtha from a suitable source in the refinery. In a preferred embodiment, the invention is practiced in its own distinct process unit, and the reaction zone is operated at process conditions that will maximize light olefin, particularly propylene, selectivity with relatively high conversion of $C_5$+olefins. Preferably, the cracking occurs under conditions resulting in at least 50% conversion of olefinic species to light olefinic species and other gases having a molecular weight of $C_4$ and below, more preferably conversion ranges from about 70–80%.

Preferred process conditions for the cracking step include temperatures from about 500° C. to about 650° C., preferably from about 525° C. to 600° C., hydrocarbon partial pressures from about 10 to 40 psia, preferably from about 20 to 35 psia; and a catalyst to naphtha (wt/wt) ratio from about 3 to 12, preferably from about 4 to 10, where catalyst weight is total weight of the catalyst composite. Though not required, it is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 1 to about 10 seconds.

Such conditions result in converting at least about 50 wt. % of the naphtha stream's $C_5$+olefins to $C_4$−products. The conditions result in less than about 25 wt. %, preferably less than about 20 wt. % conversion of the paraffins to $C_4$-products. Propylene comprises at least about 90 mol %, preferably greater than about 95 mol % of the total $C_3$ products with the weight ratio of propylene/total $C_2$−products greater than about 3.0. It is preferred that ethylene comprises at least about 90 mol % of the $C_2$ products, with the weight ratio of propylene:ethylene being greater than about 3.5 and that the 65° F. to 430° F. (i.e., "full range") $C_5$+naphtha product is either enhanced or relatively unchanged in both motor and research octanes relative to the naphtha feed. It is within the scope of this invention that the cracking catalysts be pre-coked prior to introduction of feed in order to further improve the selectivity to propylene. It is also within the scope of this invention that an effective amount of single ring aromatics be fed to the reaction zone to also improve the selectivity of propylene vs. ethylene. The aromatics may be from an external source such as a reforming process unit or they may consist of heavy naphtha recycle product from the instant process.

Among the preferred catalysts for use in the cracking step of the present invention are molecular sieve catalysts such as zeolitic fluidized catalytic cracking catalysts. More preferred catalysts include those which are comprised of a molecular sieve having an average pore diameter less than about 0.7 nanometers (nm), the molecular sieve comprising from about 10 wt. % to about 80 wt. %, preferably about 20 wt. % to about 60 wt. %, of the total fluidized catalyst composition.

Preferably, the catalyst contains phosphorus. The phosphorus may be added to the formed catalyst by impregnating the catalyst or molecular sieve with a phosphorus compound in accordance with conventional procedures. Alternatively, the phosphorus compound may be added to the multicomponent mixture from which the catalyst is formed.

Preferably, the molecular sieve is selected from the family of medium pore size (<0.7 nm) crystalline aluminosilicates, otherwise referred to as zeolites. The pore diameter, also sometimes referred to as effective pore diameter, can be measured using standard adsorption techniques and hydrocarbonaceous compounds of known minimum kinetic diameters. See Breck, *Zeolite Molecular Sieves,* 1974 and Anderson et al., J. Catalysis 58, 114 (1979), both of which are incorporated herein by reference.

Molecular sieves that can be used in the cracking step of the present invention include medium pore zeolites described in "Atlas of Zeolite Structure Types," eds. W. H. Meier and D. H. Olson, Butterworth-Heineman, Third Edition, 1992, which is hereby incorporated by reference. The medium pore size zeolites generally have a pore size from about 0.5 nm, to about 0.7 nm and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium pore size molecular sieves include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crytalline admixtures are themselves medium pore size zeolites and are not to be confused with physical admixtures of zeolites in which distinct crystals of crystallites of different zeolites are physically present in the same catalyst composite or hydrothermal reaction mixtures.

The cracking catalysts of the present invention may be held together with an inorganic oxide matrix component. The inorganic oxide matrix component binds the catalyst components together so that the catalyst product is hard enough to survive interparticle and reactor wall collisions. The inorganic oxide matrix may be made according to conventional methods from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphate.

The preferred cracking catalysts do not require steam contacting, treatment, activation, and the like to develop light olefin conversion selectivity, activity, or combinations thereof. Preferred catalysts include OLEFINS MAX™ catalyst available from W. R. Grace and Co., Columbia, Md.

As discussed, the preferred molecular sieve catalyst does not require steam activation for use under olefin conversion conditions to selectively form light olefins from a catalytically or thermally cracked naphtha containing paraffins and olefins. In other words, the preferred process propylene yield is substantially insensitive to whether the preferred molecular sieve catalysts contact steam prior to catalytic conversion, during catalytic conversion, or some combination thereof. However, steam does not detrimentally affect such a catalyst, and steam may be present in the preferred olefin conversion process.

Steam may be and frequently is present in fluidized bed reactor processes in the feed and in regions such as the reactor zone and the regenerator zone. The steam may be added to the process for purposes such as stripping and it may naturally evolve from the process during, for example, catalyst regeneration. In a preferred embodiment, steam is present in the reaction zone. Importantly, the presence of steam in the preferred process does not affect catalyst activity or selectivity for converting feeds to light olefins to the extent observed for naphtha cracking catalysts known in the art. For the preferred catalysts, propylene yield by weight based on the weight of the naphtha feed under the preferred process conditions ("propylene yield") does not strongly depend on catalyst steam pretreatment or the presence of steam in the process. Accordingly, at least about 60 wt. % of the $C_5$+olefins in the naphtha stream are converted to $C_4$−products and the reactor effluent's total $C_3$ product comprises at least about 90 mol. % propylene, preferably greater than about 95 mol. % propylene, whether or not (i) catalyst steam pretreatment is employed, (ii) steam is added to or evolves in the catalytic conversion process, or (iii) some combination of (i) and (ii) is employed.

Conventional molecular sieve catalyst steam activation procedures involving steam pretreatment and adding steam to a feed are set forth, for example, in U.S. Pat. No. 5, 171, 921. Conventionally, a steam pretreatment may employ 1 to 5 atmospheres of steam for 1 to 48 hours. When steam is added in conventional processes, it may be present in amounts ranging from about 1 mol. % to about 50 mol. % of the amount of hydrocarbon feed. Pretreatment is optional in the preferred process because the preferred catalyst's activity and selectivity for propylene yield is substantially insensitive to the presence of steam.

When a pretreatment is employed in the preferred process, it may be conducted with 0 to about 5 atmospheres of steam. By 0 atmospheres of steam it is meant that no steam is added in the pretreatment step. Steam resulting from, for example, water desorbed from the catalyst, associated pretreatment equipment, and combinations thereof may be present, usually in very small amounts, during pretreatment even when no steam is added. However, like added steam, this steam does not substantially affect the catalyst's activity for propylene yield. Adding steam to the preferred process as in, for example, stripping steam, a naphtha-steam feed mixture, or some combination thereof is also optional. When steam is added to the preferred process, it may be added in an amount ranging from about 0 mol. % to about 50 mol. % of the amount of hydrocarbon feed. As in the case of pretreatment, 0 mol. % steam means that no steam is added to the preferred process. Steam resulting from the preferred process itself may be present. For example, steam resulting from catalyst regeneration may be present, usually in very small amounts, during the preferred process even when no steam is added. However, such steam does not substantially affect the catalyst's activity for propylene yield.

When the preferred catalysts of this invention are steam pretreated and then employed in the preferred process, propylene yield changes by less than 40%, preferably less than 20%, and more preferably by less than 10% based on the propylene yield of the preferred process using an identical catalyst that was not pretreated. Similarly, when the preferred catalyst is used in the preferred process and steam is injected with the naphtha, propylene yield changes by less than 40%, preferably less than 20%, and more preferably by less than 10% based on the propylene yield of the preferred process using an identical catalyst where steam injection was not employed. Preferably, propylene yield ranges from about 8 wt. % to about 30 wt. %, based on the weight of the naphtha feed.

The Steam Activation Index test is one way to evaluate catalysts to determine whether they would require steam activation for use in napththa cracking. In accordance with the test:

(i) a candidate catalyst is calcined at a temperature of 1000° F. for four hours and then divided into two portions;

(ii) 9 grams of the first catalyst portion are contacted with hydrocarbon consisting of a catalytically cracked naphtha boiling in the range of $C_5$ to 250° F. and containing 35 wt. % to 50 wt. % olefins based on the weight of the naphtha in order to form a product containing propylene (The contacting is conducted in a model "R" ACE™ unit available from Xytel Corp Elk Grove Village, Ill. The contacting in the ACE unit is conducted under catalytic conversion conditions that include a reactor temperature of 575° C., a reactor pressure differential of 0.5 psi to 1.5 psi, a feed injection time of 50 seconds and a feed injection rate of 1.2 grams per minute.) and the amount of propylene in the product is determined;

(iii) the second catalyst portion is exposed to 1 atmosphere of steam at a temperature of 1500° F. for 16 hours; and then (iv) 9 grams of the catalyst from (iii) is contacted with the same naphtha as in (ii) in the ACE unit under the same conditions as in (ii) and the amount of propylene in the product is determined; and (v) the ratio of the wt. % yield of the propylene in (ii) to the wt. % yield of the propylene in (iv) is the Steam Activation Index.

For the preferred catalysts, the Steam Activation Index is above 0.75. More preferably, such catalysts have a Steam Activation index ranging from 0.75 to about 1, and still more preferably ranging from about 0.8 to about 1, and even more preferably from 0.9 to about 1.

As set forth above, the first step in the process of the invention comprises cracking an olefinic naphtha resulting in a cracked product having a diminished total concentration of olefinic species. The second step comprises hydroprocessing at least a portion of the cracked product in one or more hydroprocessing reactions to provide a hydroprocessed cracked product having a reduced concentration of non-hydrocarbyl species but without a substantial octane reduction. The portion of the cracked product separated for subsequent hydroprocessing may be combined with naphthas derived from other sources prior to such hydroprocessing. Preferred hydroprocessing conditions are set forth in detail below. While it is preferred that the hydroprocessing step be practiced in connection with the preferred cracking step, feeds for the hydroprocessing step may include a cracked naphtha formed in a conventional naphtha cracking reaction. Conventional naphtha cracking is set forth, for example, in U.S. Pat. No. 5,171,921, incorporated by reference herein.

The term "hydroprocessing" is used broadly herein and includes processes such as hydrofining, hydrotreating, and hydrocracking. As is known by those of skill in the art, the degree of hydroprocessing can be controlled through proper selection of catalyst as well as by optimizing operation conditions. Preferably, the hydroprocessing occur under conditions, set forth in detail below, that do not result in converting a substantial portion of olefins into paraffins, but that do result in the removal of objectionable species including non-hydrocarbyl species that may contain sulfur, nitrogen, oxygen, halides, and certain metals. Such conditions are referred to herein as "selective hydroprocessing" conditions.

While the hydroprocessing step of the invention may be performed under conventional hydroprocessing conditions, selective hydroprocessing conditions are preferred because, it is believed, they result in a hydroprocessed product that is not substantially lower in octane than the cracked product of step (a).

Accordingly, the preferred hydroprocessing reaction is performed at a temperature ranging from about 200° C. to about 400° C., more preferably from about 250° C. to about 375° C. The reaction pressure preferably ranges from about 50 to about 1000 psig, more preferably from about 50 to about 300 psig. The hourly space velocity preferably ranges from about 0.1 to about 10 V/V/Hr, more preferably from about 2 to about 7 V/V/Hr, where V/V/Hr is defined as the volume of oil per hour per volume of catalyst. The hydrogen containing gas is preferably added to establish a hydrogen charge rate ranging from about 500 to about 5,000 standard cubic feet per barrel (SCF/B), more preferably from about 1000 to about 3000 SCF/B.

Hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydroprocessor feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Use of such a reactor would be especially beneficial in cases where the feedstocks include solids in excess of about 25 micron size, or contain contaminants which increase the propensity for foulant accumulation, such as olefinic or diolefinic species or oxygenated species. Moving bed reactors utilizing downward-flowing liquid and gas can also be applied, as they would enable on-stream catalyst replacement.

The catalyst used in the hydroprocessing stages may be any hydroprocessing catalyst suitable for aromatic saturation, desulfurization, denitrogenation or any combination thereof. Preferably, the hydroprocessing catalyst contains at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkinson. The Group VIII metal is preferably present in an amount ranging from 0.5–20 wt. %, preferably 1–12 wt. %. Preferred Group VIII metals include Co, Ni, and Fe, with Co and Ni being most preferred. The preferred Group VI metal is Mo which is present in an amount ranging from 1–50 wt. %, preferably 1.5–40 wt. %, and more preferably from 2–30 wt. %.

Where selective hydroprocessing is employed, and especially where selective hydrodesulfurization is employed, a preferred hydroprocessing catalyst may contain 1–10 wt. % $MoO_3$ and 0.1–5 wt. % CoO supported on alumina, silica-alumina, or other conventional support materials. Generally, the support surface area may range from about 100 to about 400 $m^2/g$. The catalyst may contain small amounts of iron and $SO_4$. The total surface area of the catalyst may range from 150 to 350 $m^2/g$ while the pore volume may range from about 0.5 to about 1.0 $cm^3/g$, as measured by mercury intrusion. When metals are impregnated into or on to the support, the impregnation should be conducted to provide a final catalyst composition having oxygen chemisorption values set forth in the range of Table 1. The catalyst may also contain 0–10 wt. % phosphorus which may be added at any time during catalyst preparation.

In the selective hydrotreating process, the catalyst may be loaded into the hydrotreating reactor in the oxidized form and sulfided by standard methods prior to treating the cracked naphtha.

TABLE 1

Metals Dispersion by the Oxygen Chemisorption Test*

| | μmol oxygen/gram $MoO_3$ | |
|---|---|---|
| | Minimum | Maximum |
| Broad Range | 800 | 2800 |
| Preferred | 1000 | 2200 |
| Most Preferred | 1200 | 2000 |

*Oxygen chemisorption measured on sulfided catalysts.

In a preferred embodiment, the selective hydroprocessing catalyst may contain 0–5 wt. % Group IA elements, especially potassium for activity, selectivity, or a combination of activity and selectivity enhancements. The elements may be added at any time during the preparation of the catalyst.

The selective hydroprocessing catalyst when used in accordance with the selective hydroprocessing conditions set forth in this invention provides both high activity and selectivity for selective naphtha hydroprocessing. The high activity may provide process improvements such as one or more of additional naphtha throughput at the same level of sulfur removal, longer cycle lengths, and reduced catalyst costs. The high selectivity of the catalyst provides abated olefin hydrogenation at a given sulfur removal level as compared to conventional hydroprocessing catalysts. The olefin hydrogenation abatement leads to reduced hydrogen consumption and eliminates or substantially diminishes octane losses in the hydrotreated naphtha.

All metals and metal oxide weight percents given are on support. The term "on support" means that the percents are based on the weight of the support. For example, if a support weighs 100 g, then 20 wt. % Group VIII metal means that 20 g of the Group VIII metal is on the support.

Any suitable inorganic oxide support material may be used for the hydroprocessing catalyst of the present invention, including the selective hydroprocessing catalyst. Preferred are silica alumina and silica-alumina, including crystalline alumino-silicate such as zeolite. More preferred is alumina. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 A, preferably, 70–150 A, and a surface area from 50–450 $m^2/g$.

The naphtha product resulting from the hydroprocessing step may contain olefins, saturates, aromatics, non-hydrocarbyl species, and mixtures thereof. Species present boil primarily in the naphtha boiling range, and more preferably in the range of 65° F. to 150° F. The amount of olefin in the naphtha product may range from trace amounts, in the case of conventional hydroprocessing under relatively severe conditions, to more than 90 wt. % of the of the naphtha product, in the case of selective hydroprocessing under relatively mild conditions. Preferably, the total amount of olefin in the naphtha product ranges from about 1 wt. % to about 90 wt. %, more preferably from about 5 wt. % to about 50 wt. %, and still more preferably from about 10 wt. % to about 30 wt. %, the wt. % being based on the weight of the naphtha product.

EXAMPLES

Table 2 illustrates the advantages of hydroprocessing the cracked product obtained from olefinic naphtha re-cracking by comparing with conventional and selective naphtha hydroprocessing of the olefinic naphtha. A sample (Example #1) of Light Cat Naphtha (LCN) containing 490 ppm S and 42.8% vol.% olefins (84.5 MON, 90.5 RON) was hydroprocessed (Example #2) under conventional hydroprocessing conditions using a conventional Ni/Mo on alumina catalyst in order to substantially remove sulfur-containing species. Hydroprocessing led to a loss of 12.0 octane numbers (R+M/2) resulting, it is believed, from the high level of olefin saturation (99.9 Vol.%).

A sample (Example #3) of light cat naphtha ("LCN") and intermediate cat naphtha ("ICN") containing 185 ppm S and 47.6 wt. % olefins was hydroprocessed under selective hydroprocessing conditions with a highly selective catalyst containing 5.2 wt. % $MoO_3$ and 1.5 wt. % CoO on an alumina support with a 87 A median pore diameter and a surface concentration of $1.9\times10^{-4}$ gm $MoO_3/M^2$. to produce a hydrotreated product (Example #4) with 81.6% S removal. At these conditions, olefin saturation (10.3%) and octane loss (1.05 R+M/2) are low.

For comparison, Example #3 was first converted in accordance with the cracking step of this invention, providing 40% conversion to products boiling below the naphtha boiling range (i.e., lighter products) and an increase of 0.2 octane (Example #5). The unconverted cracked product was separated and then selectively hydroprocessed (Example #6)

with the highly selective catalyst of Example #4 to achieve the same S level as in Example #4. This was accomplished at a lower hydroprocessing severity (3.71 vs. 3.27 LHSV) and with minimal octane loss (−1.9 R+M/2). The reduced hydroprocessing severity combined with the reduced naphtha volume resulted in a beneficial reduction in hydroprocessor reactor volume requirements by 50% in Example #6 compared with Example #4.

TABLE 2

| Example # Relative Amount Feedstock | 1 Base LCN | 2 Base LCN Conven. | 3 Base 75% LCN/ 25% ICN | 4 Base 75% LCN/ 25% ICN Selective | 5 0.6 of Base 75% LCN/ 25% ICN Cracked | 6 0.6 of Base 75% LCN/ 25% ICN Cracked Selective |
|---|---|---|---|---|---|---|
| Hydro-processing Conditions | | | | | | |
| Catalyst | | KF-840 | | RT-225 | | RT-225 |
| LHSV, Hr-1 | | 3.27 | | 3.28 | | 3.71 |
| Tempera-ture, F. | | 475 | | 525 | | 525 |
| Pressure, inlet psia | | 190 | | 165 | | 165 |
| TGR, SCF/B | | 1598 | | 2000 | | 2000 |
| Feed/Pro-duct Com-parison | | | | | | |
| H2 Con-sumption | | 462 | | 75 | | 40 |
| % HDS | | 99.9 | | 81.6 | | 82.8 |
| % Bro-mine No. Reduction | | 99.9 | | 10.3 | | 16.5 |
| Sulfur, wppm | 490 | 0.1 | 185 | 34 | 204 | 35 |
| FIA, vol. % Olefins | 42.8 | 0.5 | 47.6 | 40.1 | 14.3 | 15.3 |
| Olefins wt. % by GC | | | 46.5 | 36.8 | 16.9 | 16.6 |
| Bromine Number | 66 | 0.036 | 72.4 | 65 | 32.5 | 27.1 |
| MON, Engine | 78.4 | 71.2 | 80 | 78 | 80.2 | 78 |
| RON, Engine | 90.5 | 73.7 | 90.2 | 90.1 | 90.4 | 88.4 |
| (R + M)/ 2, Engine | 84.5 | 72.5 | 85.1 | 84.05 | 85.3 | 83.2 |
| Octane Change, R + M/2 | | −12 | | −1.05 | 0.2 | −1.9 |
| MON, PIONA | | | 80.5 | 77.3 | 79.3 | 79.2 |
| RON, PIONA | | | 92.8 | 89.1 | 88.6 | 88.5 |

What is claimed is:

1. A process forming a hydroprocessed product comprising:

(a) reacting a naphtha feedstock containing paraffins and olefins with a catalyst containing 10 to 50 wt. % of a crystalline molecular sieve, based on the weight of the catalyst having an average pore diameter less than about 0.7 nm under catalytic conversions conditions in order to form a naphtha product, wherein the naphtha feedstock is a thermally or catalytically cracked naphtha having a boiling range of about 65° F. to about 430° F., and wherein the catalytic conversion conditions include a temperature ranging from about 500° C. to about 650° C., a hydrocarbon partial pressure ranging from about 10 to about 40 psia, a hydrocarbon residence time ranging from about 1 to about 10 seconds, and a catalyst to feed ratio, by weight, of about 3 to 12, wherein the naphtha feedstock contains about 5 wt. % to about 30 wt. % paraffins and from about 15 wt. % to about 70 wt. % olefins, wherein no more than about 20 wt. % of paraffins are converted to light olefins, and then (b) contacting at least a portion of the naphtha product with a catalytically effective amount of a hydroprocessing catalyst under hydroprocessing conditions in order to form the hydroprocessed product.

2. The process of claim 1 wherein the naphtha feedstock has a boiling range of about 65° F. to about 300° F. and is derived from at least one of fluid catalytically cracked gas oil and residual oil.

3. The process of claim 1 wherein the hydroprocessing conditions include a hydroprocessing temperature ranging from about 200° C. to about 400° C., a hydroprocessing pressure ranging from about 50 psig to about 1000 psig, a hydroprocessing hourly space velocity ranging from about 0.1 V/V/Hr to about 10 V/V/Hr, wherein V/V/Hr is the volume of the naphtha product per hour per volume of the hydroprocessing catalyst.

4. The process of claim 3 further comprising adding a hydrogen-containing gas in step (b) at a hydrogen charge rate ranging from about 500 SCF/B to about 5,000 SCF/B.

5. The process of claim 4 wherein the hydroprocessing catalyst contains at least one Group VIII metal and at least one Group VI metal on an inorganic refractory support.

6. The process of claim 5 wherein the hydroprocessing catalyst is a sulfided hydrodesulfurization catalyst containing about 1 wt. % to about 10 wt. % $MoO_3$ and about 0.1 wt. % to about 5 wt. % CoO, the wt. % being base on the weight of the support; wherein the refractory support is at least one of silica, alumina, and silica-alumina having a surface area ranging from about 100 $m^2/g$ to about 400 $m^2/g$; wherein the total surface area of the hydrodesulfurization catalyst ranges from about 150 $m^2/g$ to about 350 $m^2/g$; and wherein the hydrodesulfurization catalyst has a pore volume ranging from about 0.5 $cm^3/g$ to about 1.0 $cm^3/g$, as measured by mercury intrusion.

7. The process of claim 6 wherein the hydrodesulfurization catalyst further contains about 0 wt. % to about 5 wt. % of a group IA element, based on the weight of the support.

8. The process of claim 7 wherein the hydrodesulfurization catalyst has oxygen chemisorption values ranging from about 800 $\mu$mol oxygen/gram $MoO_3$ to about 2800 $\mu$mol oxygen/gram $MoO_3$.

9. A process forming a hydroprocessed product comprising:

(a) reacting a naphtha feedstock containing about 5 wt. % to about 30 wt. % paraffins and from about 15 wt. % to about 70 wt. % olefins with a crystalline molecular sieve catalyst having an average pore diameter less than about 0.7 nm to form a naphtha product, wherein no more than about 20 wt. % of paraffins are converted to light olefins, and then (b) contacting at least a portion of the naphtha product with a catalytically effective amount of a hydroprocessing catalyst under hydroprocessing conditions in order to form the hydroprocessed product.

10. The process of claim 9 wherein the hydroprocessing occurs in the presence of a hydrogen-containing gas at a hydrogen charge rate ranging from about 500 SCF/B to about 5,000 SCF/B, at a temperature ranging from about 200° C. to about 400° C., at a pressure ranging from about 50 psig to about 1000 psig, and at a hourly space velocity ranging from about 0.1 V/V/Hr to about 10 V/V/Hr, wherein V/V/Hr is the volume of the naphtha per hour per volume of the hydroprocessing catalyst, and wherein the hydroprocessing catalyst is a sulfided hydrodesulfurization catalyst containing about 1 wt. % to about 10 wt. % $MoO_3$ and about 0.1 wt. % to about 5 wt. % CoO, the wt. % being base on the weight of the support; wherein the refractory support is at least one of silica, alumina, and silica-alumina having a surface area ranging from about 100 $m^2/g$ to about 400 $m^2/g$; wherein the total surface area of the hydrodesulfurization catalyst ranges from about 150 $m^2/g$ to about 350 $m^2/g$; and wherein the hydrodesulfurization catalyst has a pore volume ranging from about 0.5 $cm^3/g$ to about 1.0 $cm^3/g$, as measured by mercury intrusion.

11. A process for forming a hydroprocessed product comprising:

(a) reacting a naphtha feedstock containing about 5 wt. % to about 30 wt. % paraffins and from about 15 wt. % to about 70 wt. % olefins with a catalyst containing 10 to 50 wt. % of a crystalline molecular sieve, based on the weight of the catalyst, having an average pore diameter less than about 0.7 nm at conditions including a temperature ranging from about 500° C. to about 650° C., a hydrocarbon partial pressure ranging from about 10 to about 40 psia, a hydrocarbon residence time ranging from about 1 to about 10 seconds, and a catalyst to feed ratio, by weight, of about 3 to 12, wherein no more than about 20 wt. % of paraffins are converted to light olefins in order to form a naphtha product, and then (b) contacting at least a portion of the naphtha product with a catalytically effective amount of a hydroprocessing catalyst in the presence of a hydrogen-containing gas at a hydrogen charge rate ranging from about 500 SCF/B to about 5,000 SCF/B, at a temperature ranging from about 200° C. to about 400° C., at a pressure ranging from about 50 psig to about 1000 psig, and at a hourly space velocity ranging from about 0.1 V/V/Hr to about 10 V/V/Hr, wherein V/V/Hr is the volume of the naphtha per hour per volume of the hydroprocessing catalyst, and wherein the hydroprocessing catalyst is a sulfided hydrodesulfurization catalyst containing about 1 wt. % to about 10 wt. % $MoO_3$ and about 0.1 wt. % to about 5 wt. % CoO, the wt. % being base on the weight of the support; wherein the refractory support is at least one of silica, alumina, and silica-alumina having a surface area ranging from about 100 $m^2/g$ to about 400 $m^2/g$; wherein the total surface area of the hydrodesulfurization catalyst ranges from about 150 $m^2/g$ to about 350 $m^2/g$; and wherein the hydrodesulfurization catalyst has a pore volume ranging from about 0.5 $cm^3/g$ to about 1.0 $cm^3/g$, as measured by mercury intrusion.

* * * * *